United States Patent [19]

Knox et al.

[11] Patent Number: 4,552,486

[45] Date of Patent: Nov. 12, 1985

[54] GROUTING METHOD - CHEMICAL METHOD

[75] Inventors: Lloyd C. Knox, Duncan, Okla.; Clayton A. Moore, London, England

[73] Assignee: Halliburton Company, Duncan, Okla.

[21] Appl. No.: 591,701

[22] Filed: Mar. 21, 1984

[51] Int. Cl.[4] ..... E02D 21/00; E02D 5/34

[52] U.S. Cl. ..... 405/227; 405/225

[58] Field of Search ..... 405/195, 224–227

[56] References Cited

U.S. PATENT DOCUMENTS

| | | |
|---|---|---|
| Re. 28,232 | 11/1974 | Bassett et al. . |
| 2,653,451 | 9/1953 | McCullough . |
| 2,927,435 | 3/1960 | Upson . |
| 2,953,904 | 9/1960 | Christenson . |
| 3,209,544 | 10/1965 | Borrmann . |
| 3,315,473 | 4/1967 | Hauber et al. . |
| 3,347,053 | 10/1967 | Manning . |
| 3,457,728 | 7/1969 | Pogonowski . |
| 3,468,132 | 9/1969 | Harris . |
| 3,533,241 | 10/1970 | Bowerman et al. . |
| 3,564,856 | 2/1971 | Blount et al. . |
| 3,570,259 | 3/1971 | Thaxton . |
| 3,592,012 | 7/1971 | Mott . |
| 3,601,999 | 8/1971 | Olsen . |
| 3,702,537 | 11/1972 | Landers . |
| 3,838,575 | 10/1974 | Clark et al. . |
| 3,839,872 | 10/1974 | Loire . |
| 3,878,687 | 4/1975 | Tragesser, Jr. . |
| 3,919,850 | 11/1975 | Coone et al. . |
| 3,967,456 | 7/1976 | Stone . |
| 4,009,581 | 4/1977 | Britton et al. . |
| 4,014,174 | 3/1977 | Mondshine . |
| 4,024,723 | 5/1977 | Mayfield et al. . |
| 4,041,718 | 8/1977 | Stone . |
| 4,047,391 | 9/1977 | Mayfield et al. . |
| 4,052,861 | 10/1977 | Malone et al. . |
| 4,063,421 | 12/1977 | Coone et al. . |
| 4,063,427 | 12/1977 | Hoffman . |
| 4,070,869 | 1/1978 | Williams . |
| 4,077,224 | 3/1978 | Coone . |
| 4,120,166 | 10/1978 | Brooks, Jr. . |
| 4,140,426 | 2/1979 | Knox . |
| 4,171,923 | 10/1979 | Landers . |
| 4,181,454 | 1/1980 | Knox et al. . |
| 4,184,790 | 1/1980 | Bassett . |
| 4,245,928 | 1/1981 | Nei et al. . |
| 4,275,974 | 6/1981 | Knox et al. . |
| 4,279,546 | 7/1981 | Landers . |
| 4,310,265 | 1/1982 | Streich . |
| 4,311,414 | 1/1982 | Baldridge . |
| 4,372,704 | 2/1983 | Knox . |
| 4,412,759 | 11/1983 | Britton et al. . |
| 4,422,805 | 12/1983 | Sweatman . |

OTHER PUBLICATIONS

Halliburton Services Cementing Services Technical Data Sheet No. C-1243, (revised), entitled "Flo--Chek SM Process".

Halliburton Services "Flo-Chek" Brochure No. C-1253, (Revised).

*Primary Examiner*—Dennis L. Taylor

*Attorney, Agent, or Firm*—James R. Duzan; Thomas R. Weaver

[57] ABSTRACT

An improved grouting method and arrangement using aqueous solutions of alkali silicate materials confined between a pair of pile seal assemblies in sealing the annular space formed between either a jacket leg or pile sleeve and a pile driven therethrough or similar annular space of an offshore platform to support a column of grout thereon so that the annular space may ultimately be filled with grouting material.

20 Claims, 2 Drawing Figures

GROUTING METHOD - CHEMICAL METHOD

BACKGROUND OF THE INVENTION

This invention relates to an improved grouting method and arrangement for grouting the annular space between either the jacket leg or pile sleeve and a pile driven therethrough or any similar annular shape of an offshore platform used in well drilling and production using an initial amount of alkali silicate material confined between a pair of pile seal assemblies on either the jacket leg or pile sleeve having a pile driven therethrough to support a column of grout in the annular space located above the upper pile seal assembly of the pair.

The prior art teaches several different methods of grouting the annular space formed between either a jacket leg or pile sleeve and a pile driven therethrough of offshore platforms. Typically, the methods involve setting a grout plug or column of grout which is supported either by the bottom of the body of water upon which the platform is installed or on a grout seal and subsequently filling the annular space above the plug with grouting material. Such typical prior art grouting methods are illustrated in U.S. Pat. No. Re. 28,232; U.S. Pat. Nos. 3,468,132; 3,878,687; 4,009,581; 4,047,391; 4,052,861; 4,063,421; 4,063,427; 4,077,224; 4,140,426; 4,171,923; and 4,275,974.

However, should such a grout plug or column not be supported by either a grout seal or bottom of the body of water, the grout will merely run out the bottom of the annular space into the surrounding water or area. Also, if some way of sealing the annulus cannot be found so that a grout plug or column can be placed in the annulus and allowed to harden, the annulus cannot be filled with grouting thereby affecting the stability of the offshore platform.

Previously, when trying to seal the annular space a wide variety of materials have been used. Typically, fast setting gypsum cements have been tried, lost circulation materials used in well drilling have been tried, etc. In some instances where the annular space is accessible, divers have sealed or tried to seal the annular space by filling it from the bottom with sacks, rags, rubber materials, etc.

However, the use of fast setting gypsum cements can plug up flow lines, lost circulation materials used in well drilling operations have not proven satisfactory since they are usually not capable of bridging large open areas, and the use of divers is expensive.

In wells, to consolidate the surface of a borehole in an incompetent formation and strengthen the bond between the surface of the borehole and cement placed therein the prior art teaches the method of forcing a multivalent cation salt into the formation, thereafter forcing an alkali metal silicate solution which has a pH less than 12.0 containing at least 12% by weight silica into the formation, and thereafter forcing an aqueous cement slurry containing at least 2% by weight of a water soluble multivalent cation salt to contact the surface of the borehole. Such a prior art method is disclosed in U.S. Pat. No. 4,014,174.

Another prior art method of grouting the annulus between either a jacket leg or pile sleeve and pile driven therethrough of an offshore platform uses alkali silicate materials to initially seal the annulus to support a column of grout thereon so that the annular space may ultimately be filled with grouting material. Such a method is described in U.S. patent application Ser. No. 425,346, filed on Sept. 28, 1982, now U.S. Pat. No. 4,493,592, assigned to the assignee of the present invention.

Typical pile grout seals of the mechanical, non-inflatable type or pile wipers used in offshore platforms are shown in U.S. Pat. Nos. 3,533,241; 3,570,259; 3,702,537; 4,047,391; 4,181,454; 4,310,265; and 4,311,414.

STATEMENT OF THE INVENTION

The present invention is directed to an improved grouting method and arrangement using aqueous solutions of alkali silicate materials confined between a pair of pile seal assemblies in sealing the annular space formed between either a jacket leg or pile sleeve and a pile driven therethrough or similar annular space of an offshore platform to support a column of grout thereon so that the annular space may ultimately be filled with grouting material.

BRIEF DESCRIPTION OF THE DRAWINGS

The present invention will be better understood when taken in conjunction with the following drawings wherein.

DESCRIPTION OF THE INVENTION

Figure 1:
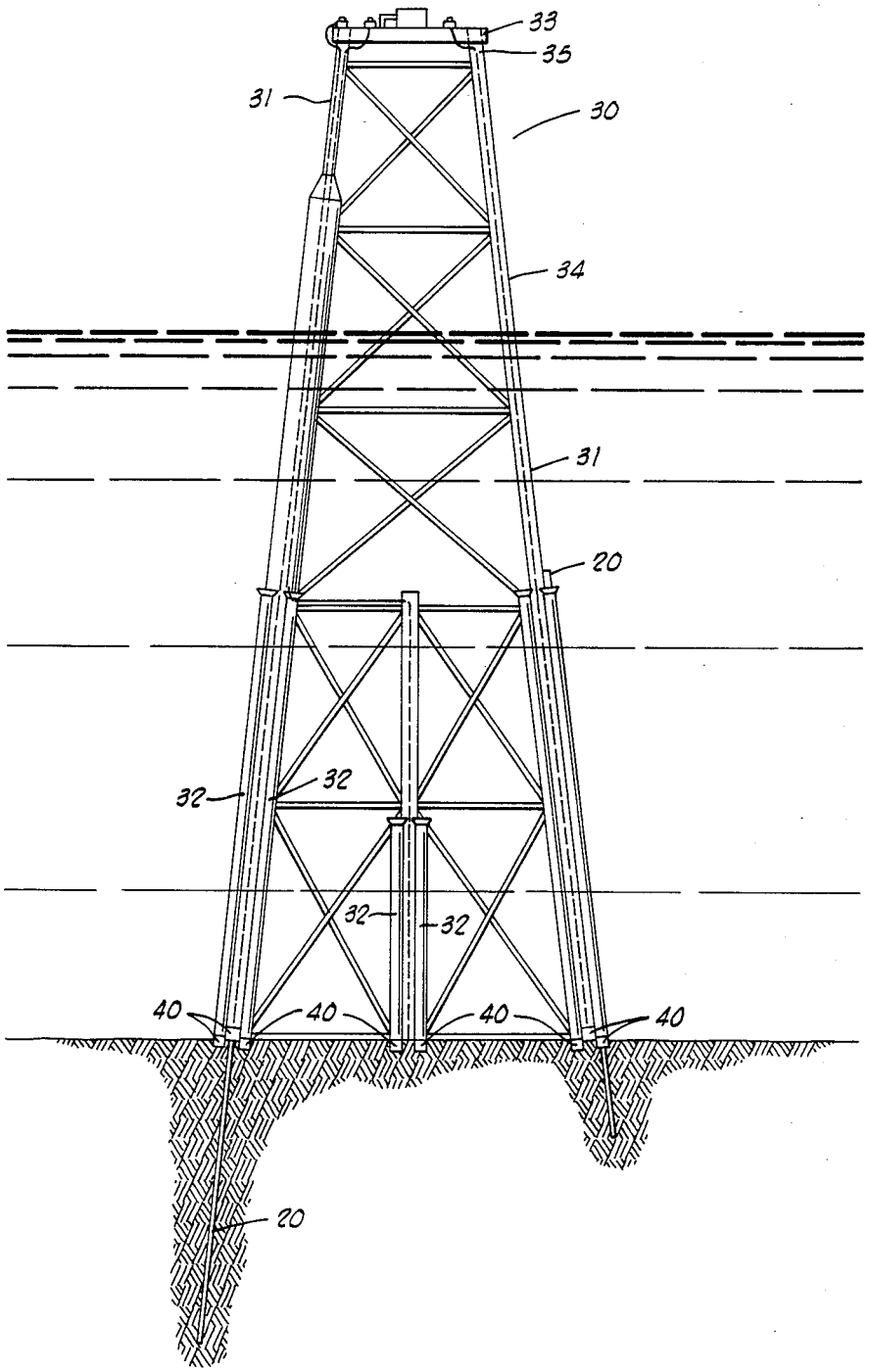
FIG. 1 shows a typical offshore platform having jacket legs and pile sleeves thereon having piling driven therethrough.

Referring to FIG. 1, an offshore platform 30 having a jacket portion 34, deck portion 33, jacket leg 31 and pile sleeve 32 is resting on the bottom of a body of water is shown having a seal assembly 40 installed on the bottom of each jacket leg 31 and pile sleeve 32. As shown, when installed, the platform 30 has the end of each jacket leg 31 and pile sleeve 32 embedded in the bottom of the body of water. Piles 20 are shown as being driven to depth through a jacket leg 31 and pile sleeve 32.

Figure 2:
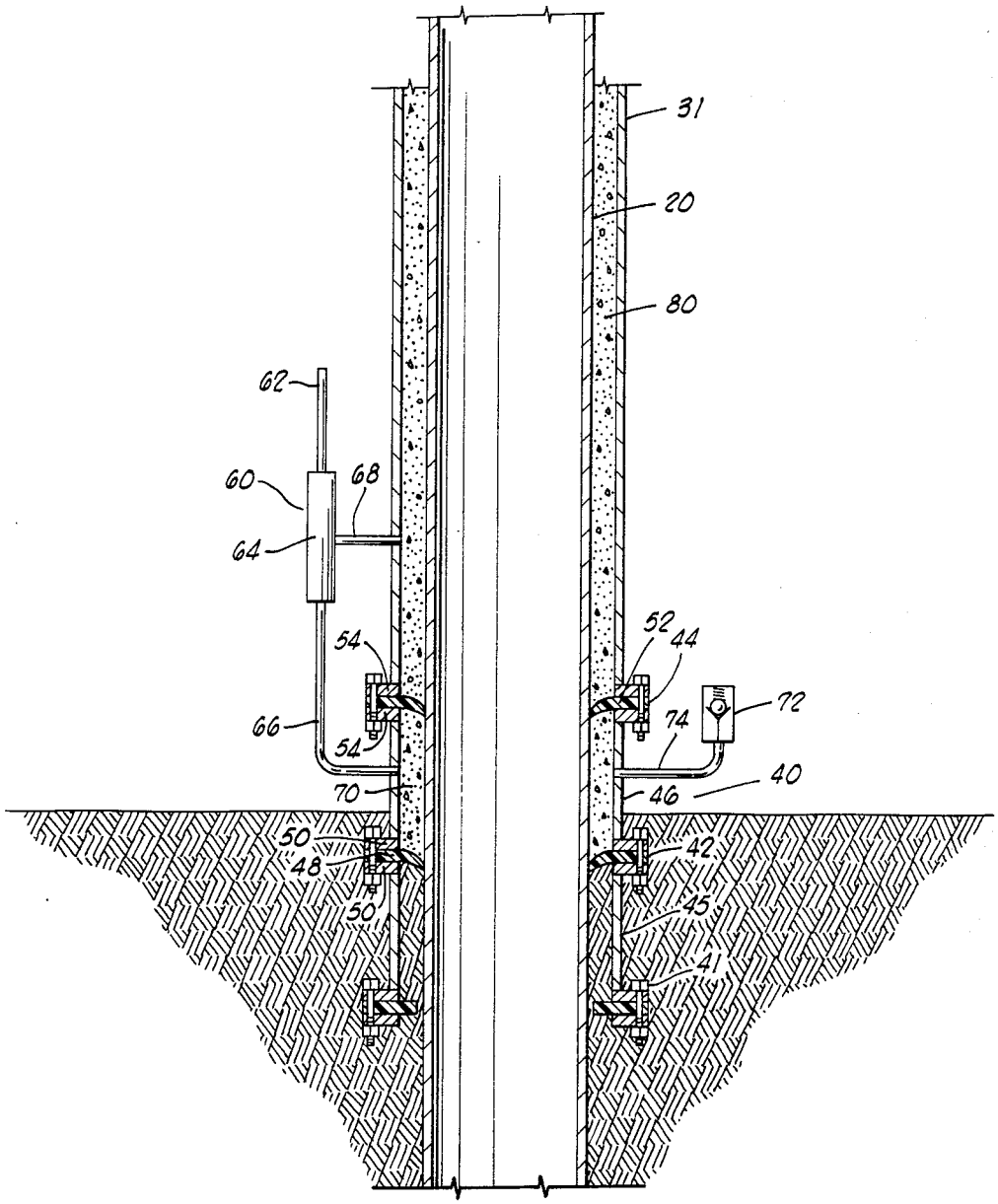
FIG. 2 shows the present invention in cross-section in leg or pile sleeve and a pile driven therethrough of an offshore platform.

Referring to FIG. 2, a seal assembly 40 which is used in the improved grouting arrangement of the present invention is shown installed on an annular support member of the platform 30, such as a jacket leg 31, although it may be a pile sleeve 32, having a pile 20 driven therethrough.

The improved grouting arrangement of the present invention comprises a seal assembly 40 having either two grout seals or pile wiper assemblies therein, a grout system 60 having a control valve 64, surface grout line 62 leading to the control valve, a first line 66 leading from the control valve 64 to the annular space 70 formed between jacket leg and pile driven therethrough and between the grout seal or pile wiper seal assemblies and a second line 68 leading from the control valve to the annular space 80 between the jacket leg and pile driven therethrough above the upper grout seal or pile wiper assembly, and a check valve 72 to control the flow of fluid from the annular space formed between a grout seal or pile wiper seal assemblies on a jacket leg 31 and between a jacket leg and pile driven therethrough.

The seal assembly 40 comprises diaphragm assembly 41, lower pile seal assembly 42, upper pile seal assembly 44, annular housing 45 connecting diaphragm assembly 41 and lower pile seal assembly 42 and housing 46 which connects the pile seal assemblies 42 and 44. For the purposes of clarity herein, the term pile seal assembly 42 or 44 will refer to either a grout seal or pile wiper seal assembly, such as disclosed in the prior art described hereinbefore, or other such suitable means for enclosure of material.

The diaphragm assembly 41 comprises an elastomeric diaphragm member which has been pierced by pile 20 being retained on the jacket leg 31 by means of annular flanges secured to housing 45.

The lower pile seal assembly 42 comprises an annular elastomeric pile seal member 42 which sealingly engages the exterior of pile 20 being retained on the jacket leg 31 by means of annular flanges 50.

The upper pile seal assembly 44 comprises an annular elastomeric pile seal member 52 which sealingly engages the exterior of pile 20 being retained on the jacket leg 31 by means of annular flanges 54.

The grouting system 60 on the jacket leg 31 comprises a surface grout line 62 running from the surface of the offshore platform to a location adjacent the lower end of the jacket leg 31 and a control valve 64 which communicates with annular space 70 formed between jacket leg 31 and pile 20 via lower line 66 and between lower pile seal assembly 42 and upper pile seal assembly 44 and annular space 80 between jacket leg 31 and pile 20 above upper pile wiper assembly 44 via upper line 68.

The control valve 64 may be of any suitable commercially available valve which is capable of alternately directing fluid flow between annular spaces 70 and 80 via lines 66 and 68 respectively; however, a ball actuated single sleeve sliding valve such as shown in U.S. Pat. No. 4,275,974 is preferred.

To control the flow of fluid from the annular space 70 during grouting operations a check valve 72 communicates via line 74 with annular space 70. By using a check valve 72 to control the flow of fluid from the annular space 70 during the initial stage of injecting material into annular space 70 during the grouting process the water from annular space 70 may be removed therefrom without forcing the water past the pile seals 42 and 44, particularly, either the lower pile seal 42 without thereby either disturbing the floor of the body of water in which the jacket leg 31 is resting so that the floor of the body of water may support the lower pile seal 42 and the pierced diaphragm 48 during grouting operations or distributing the seal of the upper pile seal 44 with the pile 20. The check valve 72 may be of any suitable commercially available type.

The improved grouting method of the present invention makes use of a material that can be pumped into annular space 70 to seal the space, have great enough load bearing strength to support in conjunction with pile seal member 52 an initial grout column in annular space 80, and that will not plug the grout line 62 after pumping the material therethrough leaving the grout line 62 suitable for further use.

The improved grouting method of the present invention makes use of such a material and comprises initially pumping or injecting a small fresh water spacer down the grout line 62 into the annular space 70, subsequently pumping or injecting an alkali silicate material which floculates upon contact with di- or multivalent cation fluids down the grout line 62 into the annular space 70 while allowing the water therein to flow therefrom through line 74 and check valve 72, then actuating the valve 64 to prevent flow therefrom via line 66 while allowing flow therefrom via line 68 into annular space 80, next pumping or injecting a fresh water spacer of any desired amount into annular space 80 to clear any remaining alkali silicate material from line 62, control valve 64 and line 68 and subsequently pumping or injecting any suitable cement or grouting material down the grout line 62 into annular space 80. If desired, a spacer fluid containing di- or multivalent cations, such as a potassium chloride solution, calcium chloride solution, etc., may be pumped into the annular space 70 before the initial fresh water spacer to provide a higher concentration of di- or multivalent cations in the annular spacer 70 with which the alkali silicate material may react.

It should be understood that the amount of fresh water in the initial fresh water spacer should be small in comparison to the volume of annular space 70 so that the annular space 70 remains substantially filled with sea water or a di- or multivalent cationic fluid with which the alkali silicate material is to react. The function of the first fresh water spacer being to prevent floculation of the alkali silicate material with sea water contained in line 62, control valve 64 and line 66 before the entry of the alkali silicate material into annular space 70. Similarly, the function of the second fresh water spacer being to prevent floculation of the alkali silicate material remaining in line 62, control valve 64 and any which may have entered into line 68 while the material is being flushed from line 62, control valve 64 and line 68 to facilitate the injection of cement or grout into annular space 80.

If desired, sand, high strength synthetic fibers such a polypropylene fibers, cellulose flakes, ground walnut shells, and other types of lost circulation materials as well as various types of cement may be included or mixed with the alkali silicate material to increase its strength thereby increasing the amount of grout column the alkali silicate material will support in conjunction with pile seals 48 and 52 in the annular space 80 during the grout injection portion of the improved grouting method.

If the alkali silicate material in conjunction with the pile seals 52 will not support a grout column in annular space 80 to completely fill the annular space 80 to the top of the jacket leg portion 34, after the initial grout in annular space 80 has hardened or set, a second injection of grout material into annular space 80 may be made to fill the annular space 80 from any convenient point on the jacket leg 31, such as from the top 35 thereof.

Also, if desired, the top of the jacket leg 31 may be sealed and compressed air or gas may be injected into the annular space 80 between the jacket leg 31 and pile 20 extending therethrough to expell water from annular space 80, past upper pile seal 52, and from annular space 70 via line 74 and check valve 72 so that the annular spaces 70 and 80 are substantially free of water before the injection of any material thereinto. However, if the water is expelled from annular space 70, unless the alkali silicate material is mixed with di- or multivalent cation fluid before the pumping thereof into the annular space 70 which mixing will increase the pumping pressure required to pump the material into annular space 70, it will be necessary to inject di- or multivalent cation fluid into the annular space 70 to floculate the alkali silicate material pumped thereinto.

If desired, alternately, the alkali silicate material may be pumped into the annular space 70 and any residual sea water in the annular space 70 and any subsequent sea water leaking past lower pile seal member 48 and/or grout or cement leaking past upper pile seal member 52 into annular space 70 may cause sufficient floculation of the alkali silicate material in annular space 70.

The improved grouting method can be used to seal the annulus between either a jacket leg or pile sleeve and a pile driven therethrough utilizing any type pile seal member 48 or 52 therein; or, any other annulus of an offshore platform where it is desired to support the pressure of a column of cement or grout. Since the alkali silicate material taken in conjunction with the pile seal members 48 and 52 has load bearing capabilities sufficient to support a substantial column of grout in the annulus 80, in many instances, the improved grouting method and arrangement effectively eliminates the need for an inflatable type grout seal at the bottom of jacket leg 31 in many instances thereby allowing a less expensive grout seal or pile wiper to be substituted therefore.

In those instances where the jacket leg 31 is not embedded in or resting on the floor of the body of water in which the platform is installed or the floor of the body of water is too soft or such a soft and muddy bottom to give effective bearing support, the pierced diaphragm and material between the diaphragm and lower pile seal 48 will help support the floculated alkali silicate material in annular space 70.

It should also be evident that the size of the check valve 72 and line 74 should be selected such that they are easily plugged by the floculated alkali silicate material.

The preferred alkali silicate material which floculates upon contact with di- or multivalent cation fluid or sea water to be used in the improved method of grouting of the current invention is an aqueous sodium silicate solution sold under the trademark FLO-CHEK ® Chemical A additive by Halliburton Services, a division of Halliburton Company.

An alternate material which can be used in the improved method of grouting of the present invention when mixed into an aqueous solution is a powdered silicate having a high ratio of silicon dioxide to alkali metal oxide sold under the trademark FLO-CHEK ® P additive by Halliburton Services, a division of Halliburton Company.

When using the preferred material, FLO-CHEK ® Chemical A additive, in the improved method of grouting and arrangement of the present invention, any desired amount of material may be pumped or injected into the annulus to be grouted depending upon the strength required to support the desired column of cement or grout to be injected into the leg to form a plug or fill the annulus. Therefore, the length of the housing between the pile seals 48 and 52 into which FLO-CHEK ® Chemical A additive is pumped or injected into the annular space 70 to be filled should be preferably at least four (4) feet of axial length of the annular space 70, to be sufficient to support an adequate column of cement or grout to be injected into the annular space 80 above pile seal 52.

Although FLO-CHEK ® Chemical A additive or FLO-CHEK ® P additive are the preferred materials to be used in the improved grouting method of the present invention, any alkali silicate having a molar ratio of silicon dioxide ($SiO_2$) to alkali metal oxide (sodium, potassium, ammonium or lithium) between approximately 1.6 or less to 4.0 may be used.

Also, although it is preferred to use an initial spacer of fresh water before the injection of the alkali silicate material and spacer of fresh water after the injection of the alkali silicate material, the fresh water spacers may be eliminated, if the alkali silicate material can be prevented from floculating during pumping through the grout line 62, grout control valve 64 and lines 66 or 68 before entering the annular space 70.

It will be obvious to those skilled in the art that such an improved grouting method and grouting arrangement may be modified to be used on a wide variety of marine structures in various locations thereon where it is desired to seal an annular space and grout the area located thereabove, such modifications being within the scope of the present invention.

Having thus described our invention, we claim:

1. A method of grouting a first and second annular space formed by an annular support member having an upper pile seal assembly and a lower pile seal assembly thereon and a pile driven therethrough of an offshore platform, said first annular space being located between said annular support member and said pile and between said upper pile seal assembly and said lower pile seal assembly, said second annular space being located between said annular support member and said pile and above said upper pile seal assembly, said method comprising the steps of:

injecting an alkali silicate material which floculates upon contact with a di- or multivalent cation fluid into said first annular space; and injecting cement or grout into said second annular space.

2. The method of grouting of claim 1 wherein said alkali silicate material is selected from a group consisting of aqueous sodium silicate, aqueous potassium silicate, aqueous ammonium silicate and aqueous lithium silicate.

3. The method of grouting of claim 1 further comprising the steps of:

injecting a spacer of fresh water into said first annular space before the step of injecting an alkali silicate material thereinto; and injecting a spacer of fresh water into said second annular space after the step of injecting the alkali silicate material into the first annular space.

4. The method of grouting of claim 1 further comprising the step of:

injecting a spacer of di- or multivalent cation fluid into said first annular space before the step of injecting an alkali silicate material thereinto.

5. The method of grouting of claim 1 wherein said alkali silicate material is an aqueous solution of FLO-CHEK ® additive.

6. The method of grouting of claim 1 wherein said annular support member comprises a jacket leg of said offshore platform.

7. The method of grouting of claim 1 wherein said annular support member comprises a pile sleeve of said offshore platform.

8. A method of grouting an offshore platform having a jacket portion including jacket legs thereon, each jacket leg having a pile driven therethrough forming an annulus between said jacket leg and pile, and a deck portion attached to the top of the jacket portion, a diaphragm assembly, a lower pile seal assembly and an upper pile seal assembly on a jacket leg forming a first annular space between said jacket leg and pile and between said lower pile seal assembly and upper pile seal assembly and forming a second annular space between said jacket leg and pile and between said pile seal assembly and the top of said jacket leg, and a grout system including a first grout line extending from the top of said jacket leg to adjacent the bottom thereof, a grout control valve having the inlet thereof connected to the first grout line, a first valve outlet line connected to said first annular space and a second valve outlet line connected to said second annular space, and a check valve connected to said jacket leg to allow fluid flow from said first annular space, said method of grouting comprising the steps of:

injecting an alkali silicate material which floculates upon contact with di- or multivalent cation fluid into said first annular space through said grout line, grout control valve and first valve outlet line; and injecting cement or grout into said second annular space through said grout line, grout control valve and second valve outlet line.

9. The method of grouting of claim 8 wherein said alkali silicate material is selected from a group consisting of aqueous sodium silicate, aqueous potassium silicate, aqueous ammonium silicate and aqueous lithium silicate.

10. The method of grouting of claim 8 further comprising the step of:

actuating said grout control valve after the step of injecting an alkali silicate material into said first annular space to prevent flow to said first annular space and to permit flow to said second annular space.

11. The method of grouting of claim 8 further including the step of:

flowing water from said first annular space to permit the injection of alkali silicate material into said first annular space.

12. The method of grouting of claim 11 wherein water flowing from said first annular space flows therefrom through said check valve connected thereto.

13. The method of grouting of claim 8 further comprising the steps of:

injecting a spacer of fresh water into said first annular space before the step of injecting an alkali silicate material thereinto; and injecting a spacer of fresh water into said second annular space after the step of injecting the alkali silicate material into the first annular space.

14. The method of grouting of claim 8 further comprising the step of:

injecting a spacer of di- or multivalent cation fluid into said first annular space before the step of injecting an alkali silicate material thereinto.

15. A grouting arrangement for an offshore platform having an annular support member having, in turn, a pile driven therethrough forming an annular space therebetween, said arrangement comprising:

a seal assembly including:

a lower pile seal assembly attached to said annular support member; and an upper pile seal assembly attached to said annular support member; and a grout system for grouting said annular space, said grout system including:

a control valve for controlling the flow of grouting material to said annular space;

a surface grout line leading to the control valve; and a first line leading from the control valve to said annular space.

16. The grouting arrangement of claim 15 wherein the grout system further comprises:

a check valve to control the flow of fluid from said annular space located between the first and second pile seal assemblies; and a second line leading from the control valve to said annular space.

17. The grouting arrangement of claim 16 wherein:

the first line of the grouting system leads from the control valve to said annular space located between the lower and upper pile seal assemblies; and the second line leads from the control valve to said annular space located above the upper pile seal assembly.

18. The grouting arrangement of claim 15 wherein said annular support member comprises a jacket leg of an offshore platform.

19. The grouting arrangement of claim 15 wherein said annular support member comprises a pile sleeve of an offshore platform.

20. The grouting arrangement of claim 15 wherein the seal assembly further comprises:

a diaphragm assembly secured to said annular support member.

* * * * *